US009646464B2

(12) United States Patent
San

(10) Patent No.: US 9,646,464 B2
(45) Date of Patent: May 9, 2017

(54) GAMING SYSTEM AND A METHOD OF GAMING

(71) Applicant: Aristocrat Technologies Australia Pty Limited, North Ryde (AU)

(72) Inventor: Kin Wai San, Maroubra (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 12 days.

(21) Appl. No.: 13/912,283

(22) Filed: Jun. 7, 2013

(65) Prior Publication Data

US 2013/0331169 A1 Dec. 12, 2013

(30) Foreign Application Priority Data

Jun. 7, 2012 (AU) ..... 2012902393

(51) Int. Cl.
*G07F 17/32* (2006.01)

(52) U.S. Cl.
CPC ..... *G07F 17/3267* (2013.01)

(58) Field of Classification Search
CPC ..... G07F 17/32; G07F 17/326; G07F 17/3267
USPC ..... 463/16–20, 25, 29
See application file for complete search history.

(56) References Cited

U.S. PATENT DOCUMENTS

| | | | | |
|---|---|---|---|---|
| 3,806,121 | A | 4/1974 | Crossley | |
| 5,226,653 | A | 7/1993 | Bil et al. | |
| 5,741,185 | A | 4/1998 | Kwan et al. | |
| 6,068,552 | A * | 5/2000 | Walker | G07F 17/3244 273/139 |
| 7,338,210 | B1 | 3/2008 | Fultz et al. | |
| 2001/0030660 | A1 | 10/2001 | Zainoulline | |
| 2002/0006822 | A1 | 1/2002 | Krintzman | |
| 2002/0010017 | A1 | 1/2002 | Bennett | |
| 2002/0025843 | A1 | 2/2002 | Bryant | |
| 2002/0025848 | A1 | 2/2002 | Graham | |
| 2002/0115485 | A1 | 8/2002 | Muir et al. | |
| 2003/0166410 | A1 | 9/2003 | Olive | |
| 2003/0207709 | A1 | 11/2003 | Paotrakul | |
| 2003/0222402 | A1 | 12/2003 | Olive | |
| 2004/0224745 | A1 * | 11/2004 | Bregenzer | 463/16 |
| 2004/0229672 | A1 | 11/2004 | Aoki et al. | |
| 2005/0059475 | A1 | 3/2005 | Breen et al. | |
| 2005/0075163 | A1 * | 4/2005 | Cuddy et al. | 463/20 |
| 2005/0143164 | A1 | 6/2005 | Duhamel et al. | |
| 2005/0159211 | A1 * | 7/2005 | Englman | G07F 17/32 463/25 |
| 2006/0052151 | A1 | 3/2006 | Gomez | |
| 2006/0135244 | A1 | 6/2006 | Stevens | |
| 2006/0183533 | A1 | 8/2006 | Tran et al. | |

(Continued)

FOREIGN PATENT DOCUMENTS

| | | |
|---|---|---|
| CA | 2281261 | 11/2000 |
| CA | 2486065 | 4/2006 |
| EP | 1343124 | 9/2003 |
| EP | 1607917 | 12/2005 |
| GB | 1290559 | 9/1972 |

(Continued)

*Primary Examiner* — Jasson Yoo
(74) *Attorney, Agent, or Firm* — McAndrews, Held & Malloy, Ltd.

(57) ABSTRACT

A gaming system for play of a base game, and arranged to detect a trigger condition during the base game. A feature game is implemented when a feature game frequency criterion is met. The feature game frequency criterion may be based on the number of base games having been implemented since the last implementation of a feature game.

18 Claims, 6 Drawing Sheets

(56) References Cited

U.S. PATENT DOCUMENTS

| | | | | |
|---|---|---|---|---|
| 2006/0205491 | A1 | 9/2006 | Daley | |
| 2007/0167207 | A1 | 7/2007 | Meyer | |
| 2008/0102928 | A1 | 5/2008 | Daley | |
| 2008/0119282 | A1 | 5/2008 | Bennett | |
| 2008/0200230 | A1 | 8/2008 | Mezen et al. | |
| 2009/0075720 | A1 | 3/2009 | Mathis | |
| 2009/0124310 | A1 | 5/2009 | Svanas et al. | |
| 2009/0131154 | A1* | 5/2009 | Chim et al. | 463/25 |
| 2009/0253488 | A1 | 10/2009 | Yoshizawa | |
| 2010/0009740 | A1 | 1/2010 | Olive | |
| 2010/0075738 | A1 | 3/2010 | Roukis | |
| 2010/0099490 | A1 | 4/2010 | Olive | |
| 2010/0120499 | A1* | 5/2010 | Cohen | 463/20 |
| 2010/0120524 | A1* | 5/2010 | Rodgers | G07F 17/3258 463/27 |
| 2012/0094738 | A1* | 4/2012 | Aoki | G07F 17/34 463/20 |
| 2012/0115568 | A1 | 5/2012 | Fujisawa | |
| 2012/0220367 | A1* | 8/2012 | Ellis | 463/27 |

FOREIGN PATENT DOCUMENTS

| | | |
|---|---|---|
| GB | 2068619 | 8/1981 |
| GB | 2098781 | 11/1982 |
| GB | 2148038 | 5/1985 |
| GB | 2191030 | 12/1987 |
| GB | 2388046 | 11/2003 |
| GB | 2411508 | 8/2005 |
| JP | 2031778 | 2/1990 |
| JP | 6133962 | 5/1994 |
| JP | 7092257 | 4/1995 |
| JP | 2002085699 | 3/2002 |
| JP | 2004153447 | 5/2004 |
| JP | 2005208196 | 8/2005 |
| JP | 2006135601 | 5/2006 |
| JP | 2006333927 | 12/2006 |
| NZ | 536936 | 2/2005 |
| NZ | 544852 | 6/2007 |
| NZ | 555196 | 12/2008 |
| RU | 2144180 | 1/2000 |
| TW | 494336 | 7/2002 |

* cited by examiner

GAMING SYSTEM AND A METHOD OF GAMING

RELATED APPLICATIONS

This application claims priority to Australian Provisional Patent Application No. 2012902393 having an International filing date of Jun. 7, 2012, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

BRIEF SUMMARY OF THE INVENTION

In accordance with a first aspect of the present invention, there is provided a gaming system comprising:

a game implementer arranged to implement a base game; and a trigger determiner arranged to detect a trigger condition during a base game;

the gaming system being arranged to implement a feature game when a trigger condition is detected during a base game; and wherein the gaming system is arranged to implement the feature game when a feature game frequency criterion is met.

In one embodiment, the feature game frequency criterion is based on the number of base games have been implemented since the last implementation of a feature game.

In one embodiment, the defined number of base games is a fixed number of base games.

In one embodiment, the defined number of base games is a randomly selected number of base games.

In one embodiment, the defined number of base games is between 500 and 1000 base games.

In one embodiment, the defined number of base games is determined based on a game condition, such as based on a previous award benefit or a previous award frequency.

In one embodiment, the trigger condition is display of at least one trigger symbol, such as a wild symbol.

In an alternative embodiment, the trigger condition is display of a particular combination of trigger symbols such as scattered predefined symbols or a particular combination of adjacently disposed symbols along a win line.

In one arrangement, the base game and/or the feature game are reel based games wherein spinning and subsequent stopping of symbol bearing reels determines game outcomes.

In one embodiment, the gaming system is arranged to provide a different benefit to a player depending on whether a winning outcome is obtained during a feature game triggered based on a trigger condition or a feature game implemented because a feature game frequency criterion is met.

In one embodiment, a smaller benefit is provided to a player obtaining a winning outcome during a feature game triggered based on a trigger condition than obtained during a feature game implemented because a feature game frequency criterion is met.

In accordance with a second aspect of the present invention, there is provided a feature game implementer for a gaming system arranged to implement a base game and a feature game, the feature game implementer arranged to determine when a feature game was last implemented and to implement a feature game when a feature game frequency criterion is met.

The gaming system may be implemented as a stand alone gaming machine or across a network.

In accordance with a third aspect of the present invention, there is provided a method of gaming comprising:

implementing a base game;

detecting a trigger condition during a base game;

implementing a feature game when a trigger condition is detected during a base game; and implementing the feature game when a defined number of base games have been implemented since the last implementation of a feature game.

In accordance with a fourth aspect of the present invention, there is provided a computer program arranged when loaded into a computer to instruct the computer to operate in accordance with a gaming system according to the first aspect of the present invention.

In accordance with a fifth aspect of the present invention, there is provided a computer readable medium having computer readable program code embodied therein for causing a computer to operate in accordance with a gaming system according to the first aspect of the present invention.

In accordance with a sixth aspect of the present invention, there is provided a data signal having computer readable program code embodied therein for causing a computer to operate in accordance with a gaming system according to the first aspect of the present invention.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

Figure 1:
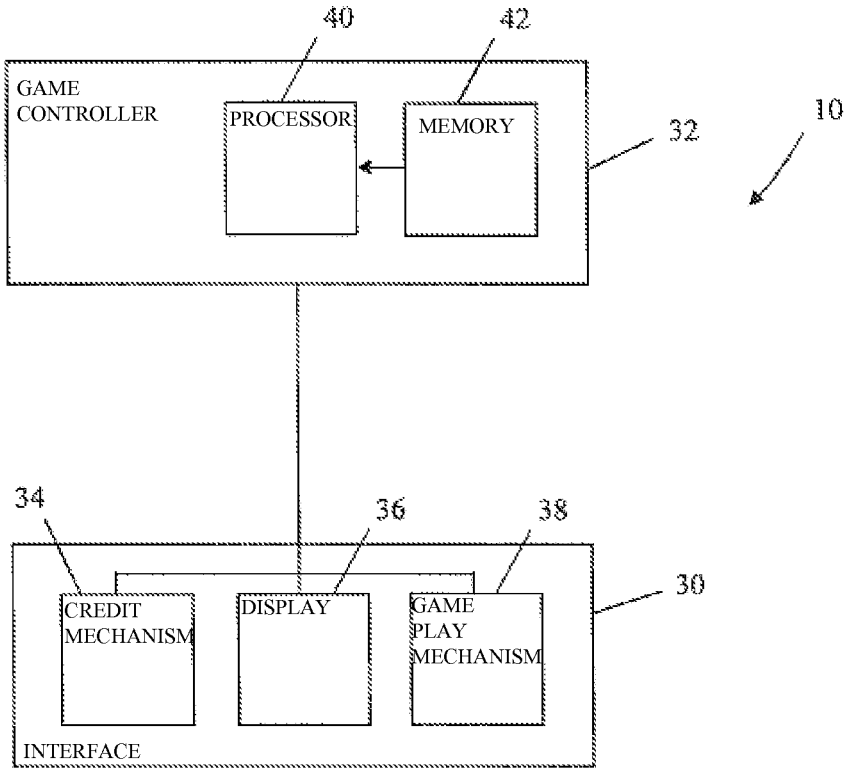
FIG. 1 is a schematic block diagram of core components of a gaming system in accordance with an embodiment of the present invention.

Referring to the drawings, there is shown a schematic block diagram of a gaming system 10 arranged to implement a probabilistic game, in this example of the type wherein several symbols from a set of symbols are randomly displayed, and a game outcome is determined on the basis of the displayed symbols. With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same win line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions. The available win lines may be fixed, may be determined on the basis of the bet placed, or may be selectable by a player.

This type of game often also comprises a base game mode and a special game mode, with special game mode being triggered when a specific trigger condition occurs during base game mode. For example, base game mode may implement a base game wherein a plurality of symbols are selected for use in determining game outcomes from a set of symbols, and special game mode may implement a feature game with the feature game being triggered when a particular symbol or combination of symbols is displayed.

The present gaming system operates such that, at least during a portion of a game implemented by the gaming system, in addition to triggering special game mode when a particular outcome is detected during a base game, special game mode may be triggered if a feature game frequency criterion is met. The feature game frequency criterion may be based on occurrence of a defined number of base games since last implementation of a feature game.

Referring to FIG. 1, a schematic diagram of core components of a gaming system 10 is shown. The core components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or any computational device such as a personal computer or a server.

Figure 2:
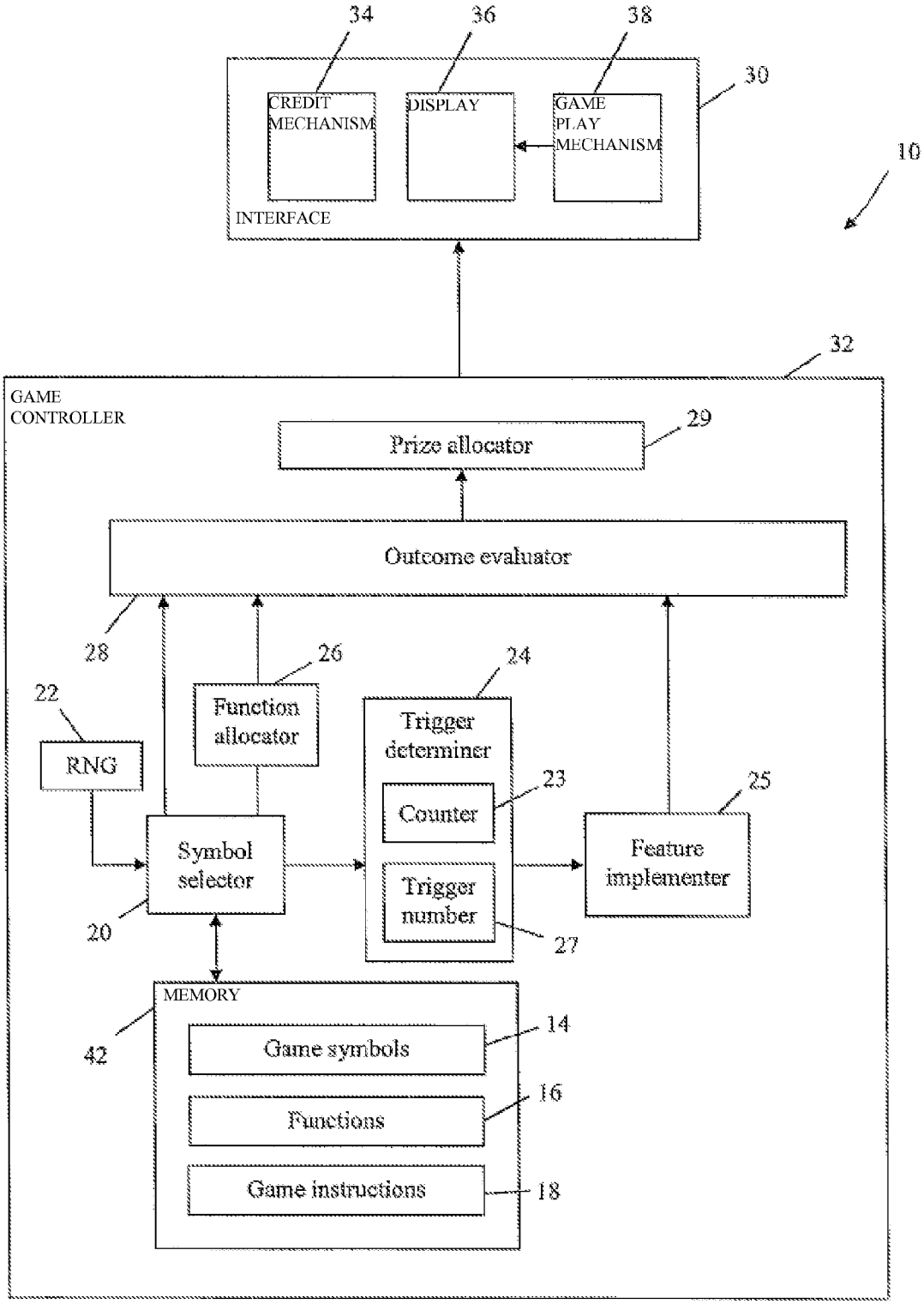
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols for use during implementation of a base game and optionally during a feature game, function data 16 indicative of one or more functions allocatable to the symbols, and game instruction data 18 usable by the gaming machine 10 to control operation of the game.

The game controller 32 includes a symbol selector 20 which is arranged to select several symbols from the stored symbols 14 for display to a player. In this example, the selection carried out by the symbol selector 20 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

In the present example, the gaming system 10 is operable in normal game mode wherein a base game is implemented and special game mode wherein a feature game is implemented. Special game mode is arranged to commence based on occurrence of a trigger condition. For this purpose, the game controller 32 also comprises a trigger determiner 24 arranged to determine whether a trigger condition exists and to commence special game mode when the trigger condition is detected.

The game controller 32 also includes a counter 23, in this example implemented by the trigger determiner 24. A trigger number 27 is also provided, which may be stored in the trigger determiner 24, in the memory 27, or in any other location. The counter 23 is used to maintain a record of the number of base games which have been implemented since the last feature game, and the trigger determiner is arranged to trigger implementation of a feature game if the counter 23 reaches the trigger number 27. In this way, two mechanisms are provided for triggering a feature game; a first triggering mechanism based on base game outcomes; and a second triggering mechanism based on the number of base games since last implementation of a feature game. This serves to maintain player enjoyment because the player never has to wait longer than a defined number of base games until a feature game is implemented.

The trigger number 27 may be predefined, may be randomly selected, for example using the random number generator 22, may be derived based on previous game outcomes and/or previous prize awards, or may be determined in any other way.

In this example, the game controller 32 also comprises a function allocator 26 arranged to select and allocate one or more functions to one or more symbols. Such functions include a wild function, a scatter function, or any other function which may be applied to a symbol or to the game.

The game controller 32 also comprises an outcome generator 28 which in accordance with the game instructions 18 determines game outcomes in this example based on the symbols selected for display to a player by the symbol selector 20.

In the embodiments described below, the symbol selector 20, the trigger determiner 24, the feature implementer 25, the function allocator 26, and the outcome generator 28 are at least partly implemented using the processor 39 and associated software, although it will be understood that other implementations are envisaged.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to play audible and/or display visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
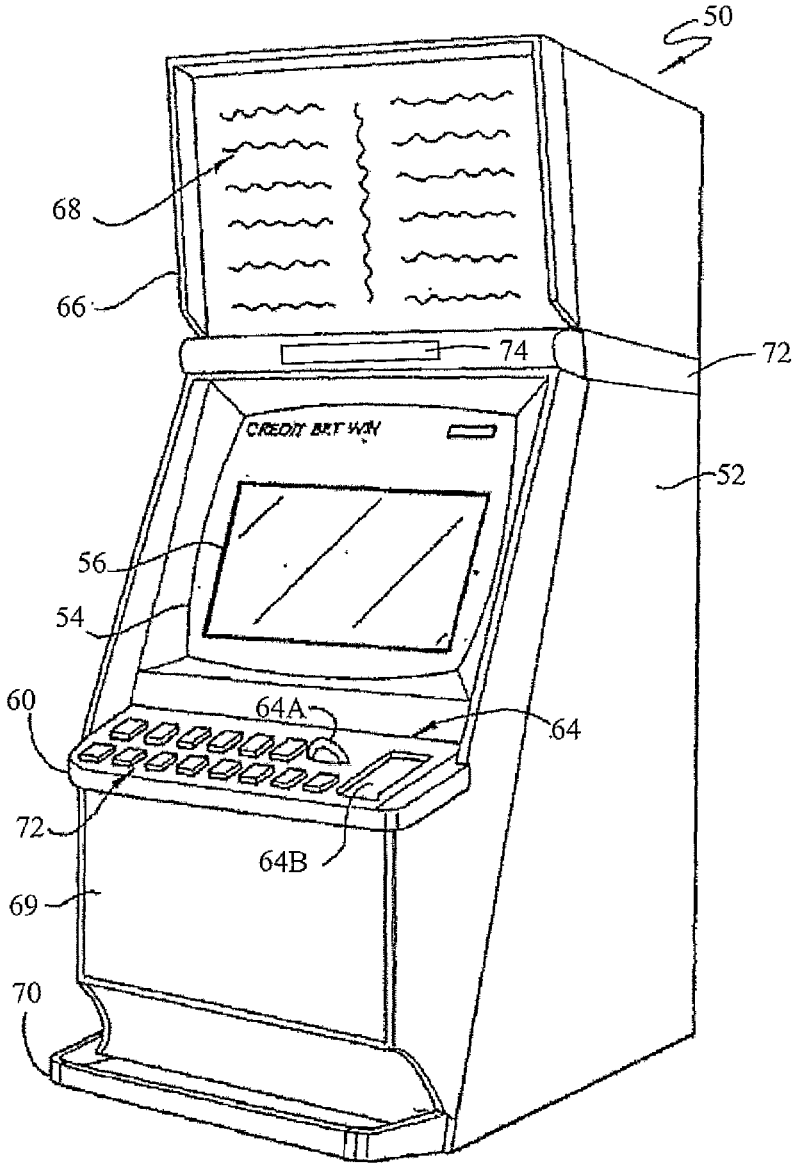
FIG. 3 is a diagrammatic representation of a gaming system in accordance with an embodiment of the present invention with the gaming system implemented in the form of a stand alone gaming machine.

A gaming system in the form of a stand alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 62 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type.

The display 54 in this example is arranged to display representations of several reels, each reel of which has several associated symbols. Typically 3, 4 or 5 reels are provided. During operation of the game, the reels first appear to rotate then stop with typically three symbols visible on each reel.

A player marketing module (PMM) 72 having a display 4 is connected to the gaming machine 10. The main purpose of the PMM 72 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 72 is a Sentinel III device produced by Aristocrat Technologies Pty Ltd.

Figure 4:
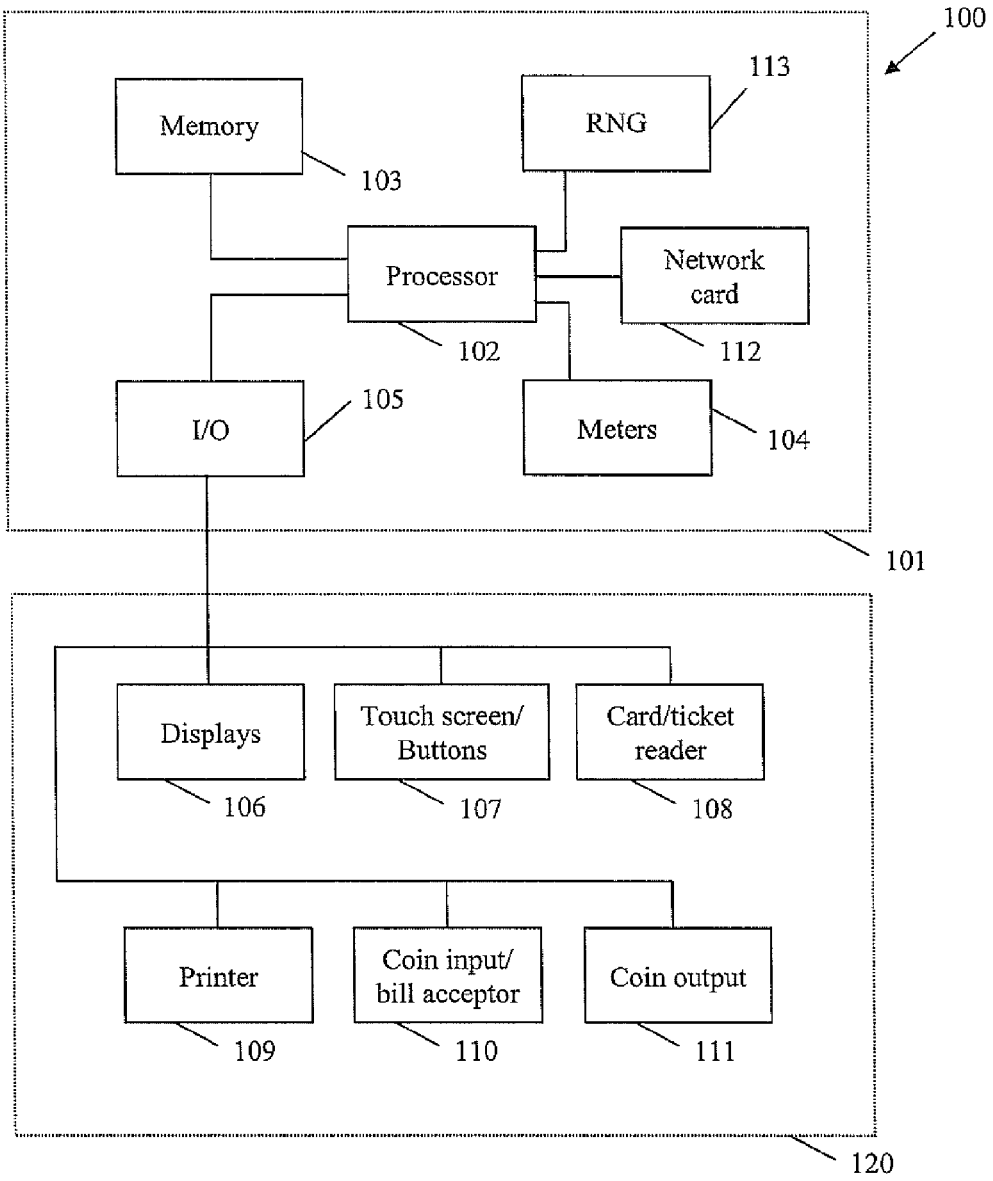
FIG. 4 is a schematic block diagram of operative components of the gaming machine shown in FIG. 3.

FIG. 4 shows a block diagram of operative components of a typical gaming machine 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
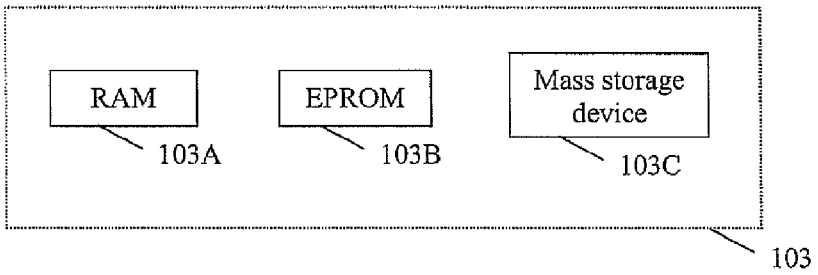
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

Figure 6:
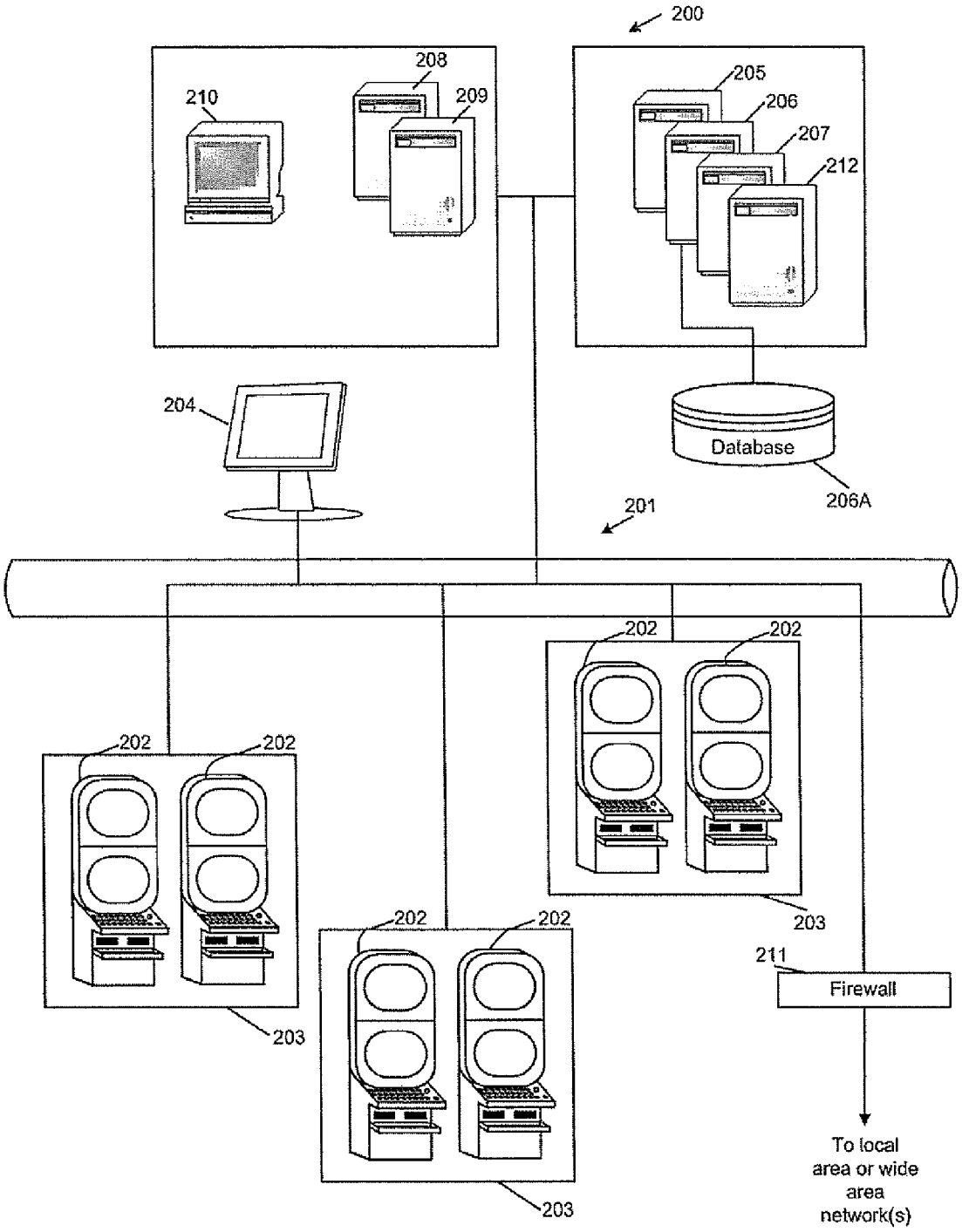
FIG. 6 is a schematic diagram of a gaming system in accordance with an alternative embodiment of the present invention with the gaming system implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

Figure 7:
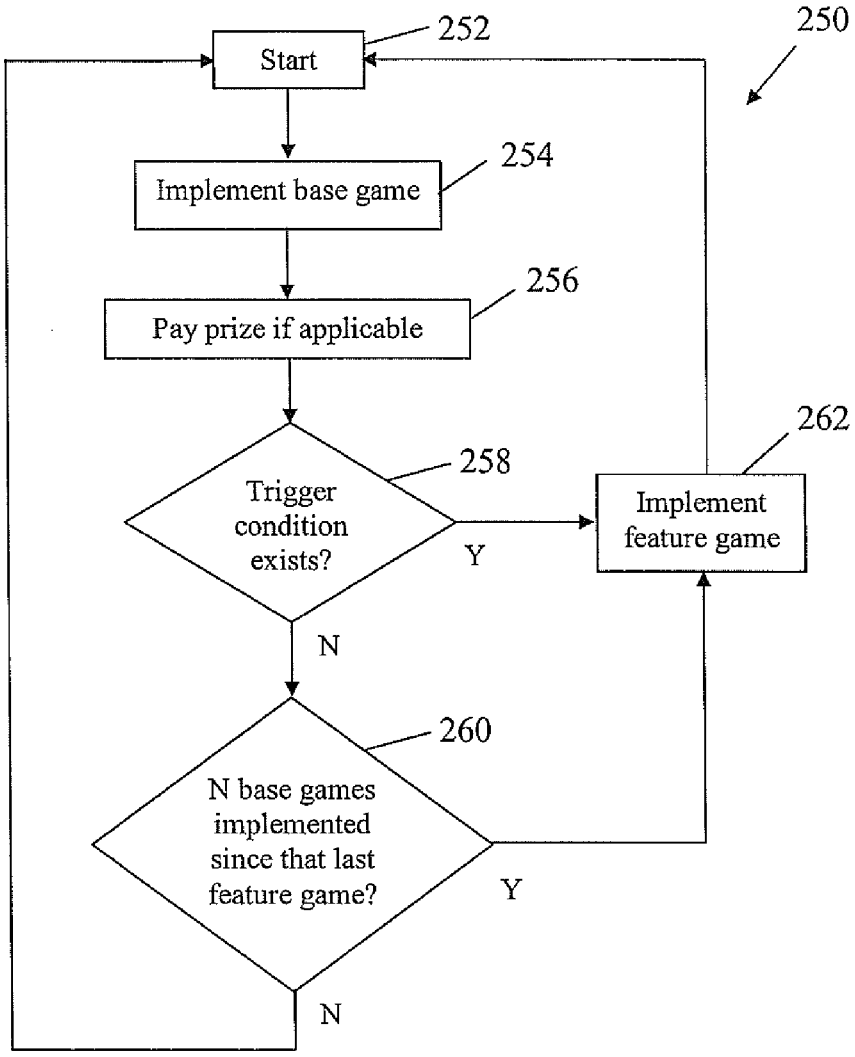
FIG. 7 is a flow diagram illustrating a method of gaming in accordance with an embodiment of the present invention.

Examples of specific implementations of the gaming system will now be described with reference to flow diagram 20 shown in FIG. 7 which illustrates steps 252 to 262 of a method of gaming implemented by the gaming system.

In one embodiment, the gaming system operates in normal game mode wherein a base game is implemented and, when a trigger condition occurs, in special game mode wherein a feature game is implemented.

In the present embodiment, the base game and the feature game are of a type including multiple rotatable reels, which may be physical reels or virtual reels, with each reel having a plurality of symbols and optionally one or more function symbols. Win outcomes are determined on the basis of the symbols visible when the reels stop rotating, and in this example three symbols are displayed on each reel at any time. A win outcome may occur based on display of the same symbol along normal win lines which may extend horizontally, diagonally, or in any other predefined continuous line. A win outcome may also occur based on display of multiple scattered symbols at any display location. A win outcome may also occur on the basis of one or more standard symbols in combination with at least one function symbol having an assigned function. For example a function symbol may correspond to a wild function, a scatter function, a multiply function, a repeat win function, and so on.

During a base game, win outcomes are determined on the basis of the symbols displayed on the reels after the reels have stopped rotating. During a feature game, one or more modifications may be made to the base game to change the operation or appearance of the base game, or a different game entirely to the base game may be implemented. For example, in one feature game, the symbol set from which the displayed symbols are selected may be substituted for another symbol set different to the first symbol set.

The gaming system is arranged to commence special game mode when a trigger condition exists 258, in this example when a predetermined game outcome occurs such as when a specific combination of symbols is displayed such as scattered CAT symbols.

The gaming system is also arranged to commence special game mode when a feature game frequency criterion is met such as when N base games have been implemented without implementation of a feature game 260. For example N may be defined as a number of base games between 500 and 1000, or any other appropriate number of base games. N may be a fixed defined number of base games, may be determined randomly, such as a number between 5000 and 1000 determined using the random number generator 22, may be determined based on game outcomes or prize benefit amounts or prize benefit frequency, for example such that N is relatively large if relatively large benefits have recently been provided or N is relatively small if relatively small benefits have recently been provided, or may be determined in any other way.

The number of implemented base game is monitored by a counter 23. After implementation of a feature game, the counter 23 is reset to zero.

In one embodiment, the gaming system is arranged to provide a different benefit to a player for a game outcome occurring during a feature game triggered using the counter 23 than would be awarded for a similar game outcome occurring during a feature game triggered in response to a trigger condition. For example, if a feature game offers benefits which are 3 times the amount of corresponding benefits provided during a base game, the feature game triggered using the counter 23 may offer benefits which are 10 times the amount of corresponding benefits provided during a base game.

While the above embodiment is described in relation to a base game and a feature game using multiple rotatable reels and symbols which are selected for use in determining game outcomes using the reels, other types of base game and feature game are envisaged, such as card or dice based games.

In the claims of this application and in the description of the invention, except where the context requires otherwise due to express language or necessary implication, the words "comprise" or variations such as "comprises" or "comprising" are used in an inclusive sense, i.e. to specify the presence of the stated features but not to preclude the presence or addition of further features in various embodiments of the invention.

Modifications and variations as would be apparent to a skilled addressee are deemed to be within the scope of the present invention.

The invention claimed is:

1. A gaming machine for playing a base game and a feature game, the gaming machine comprising:

a credit input mechanism configured to receive a physical item representing a monetary value for establishing a credit balance, the credit balance being increasable and decreasable based at least on wagering activity;

hardware meters configured to monitor the credit input having been provided by the credit input mechanism;

a manually operable player interface configured for player interaction to place a wager, in accord with said credit balance having been provided by the credit input mechanism, and to receive a manual physical input associated with the base game;

a game controller configured to, in accord with the placed wager, initiate the base game, and to detect a trigger condition during the base game; and a memory configured to store a trigger number based on prize awards having been previously awarded;

a video display operable to display the base game and the feature game, and wherein the game controller is further configured to initiate and to cause the video display to display the feature game with a first feature prize when the trigger condition is detected during the base game, and to initiate and to cause the video display to display the feature game with a second feature prize when a feature game frequency criterion is met, the feature game frequency criterion being based on said trigger number; and an output mechanism configured to provide payouts based on one of the first feature prize and the second feature prize in response to winning the feature game.

2. A gaming machine as claimed in claim 1, and wherein the trigger condition is a display of at least one trigger symbol on the video display.

3. A gaming machine as claimed in claim 2, wherein the at least one trigger symbol is at least one wild symbol.

4. A gaming machine as claimed in claim 1, and wherein the trigger condition is a display of a particular combination of trigger symbols on the video display.

5. A gaming machine as claimed in claim 1, wherein at least one of the base game and the feature game is a reel based game having a plurality of reels, each reel bearing a plurality of symbols, and wherein spinning and subsequent stopping of the reels determine game outcomes.

6. A gaming machine as claimed in claim 1, wherein the output mechanism is configured to provide the first feature prize when a winning outcome is obtained during the feature game triggered based on the trigger condition, and the second feature prize when the winning outcome is obtained during the feature game initiated when the feature game frequency criterion is met.

7. A gaming machine as claimed in claim 6, wherein the output mechanism is further configured to provide a) the first feature prize to a winning outcome obtained during the feature game triggered based on the trigger condition, and b) the second feature that has a larger prize to a winning outcome obtained during the feature game initiated when the feature game frequency criterion is met.

8. A gaming machine as claimed in claim 1, wherein the gaming machine is implemented as a standalone gaming machine or across a network.

9. The gaming machine as claimed in claim 1, wherein said first feature prize is different than said second feature prize.

10. A method of gaming for use with a gaming machine playing a base game and a feature game, and having a credit input mechanism configured to receive a physical item representing a monetary value for establishing a credit balance, the credit balance being increasable and decreasable based at least on wagering activity, hardware meters configured to monitor the credit input having been provided by the credit input mechanism, a manually operable player interface configured for player interaction to place a wager, in accord with said credit balance having been provided by the credit input mechanism, and to receive a manual physical input associated with the base game, a memory configured to store trigger number based on prize awards having been previously awarded, a video display operable to display the base game and the feature game, an output mechanism configured to provide payouts, and a game controller, the method comprising:

in accord with the placed wager, initiating via the game controller the base game;

detecting via the game controller a trigger condition during the base game;

initiating via the game controller and causing the video display to display the feature game with a first feature prize when the trigger condition is detected during the base game;

initiating via the game controller and causing the video display to display the feature game with a second feature prize when a feature game frequency criterion is met, the feature game frequency criterion being based on trigger number; and providing via the output mechanism payouts based on one of the first feature prize and the second feature prize in response to winning the feature game.

11. A method as claimed in claim 10, wherein the trigger condition is a display of at least one trigger symbol on the display.

12. A method as claimed in claim 11, wherein the at least one trigger symbol is at least one wild symbol.

13. A method as claimed in claim 10, wherein the trigger condition is a display of a particular combination of trigger symbols on the video display.

14. A method as claimed in claim 10, wherein at least one of the base game and the feature game is a reel based game having a plurality of reels, each reel bearing a plurality of symbols, and the method further comprising spinning and stopping of the reels, and wherein the spinning and subsequent stopping of the reels determines game outcomes.

15. A method as claimed in claim 10, further comprising the output mechanism providing the first feature prize when a winning outcome is obtained during the feature game triggered based on the trigger condition, and the second feature prize when the winning outcome is obtained during the feature game initiated when the feature game frequency criterion is met.

16. A method as claimed in claim 15, further comprising the output mechanism providing a) the first feature prize to a winning outcome obtained during the feature game triggered based on the trigger condition and b) the second feature that has a larger prize to a winning outcome obtained during the feature game initiated when the feature game frequency criterion is met.

17. A method as claimed in claim 10, wherein the gaming machine is implemented as a standalone gaming machine or across a network.

18. The method as claimed in claim 10, wherein said first feature prize is different than said second feature prize.

* * * * *